US009166310B2

(12) United States Patent
Ludwig

(10) Patent No.: US 9,166,310 B2
(45) Date of Patent: Oct. 20, 2015

(54) PRESS-IN CONTACT HAVING A BASE, A CONTACT PIN AND A SECOND PIN

(75) Inventor: Ronny Ludwig, Bodelshausen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 880 days.

(21) Appl. No.: 12/812,546

(22) PCT Filed: Dec. 18, 2008

(86) PCT No.: PCT/EP2008/067831

§ 371 (c)(1),
(2), (4) Date: Oct. 1, 2010

(87) PCT Pub. No.: WO2009/089981

PCT Pub. Date: Jul. 23, 2009

(65) Prior Publication Data

US 2011/0039428 A1 Feb. 17, 2011

(30) Foreign Application Priority Data

Jan. 17, 2008 (DE) ..... 10 2008 004 882

(51) Int. Cl.
*H01R 12/00* (2006.01)
*H01R 12/58* (2011.01)

(52) U.S. Cl.
CPC ..... *H01R 12/585* (2013.01); *Y10T 29/49128* (2015.01)

(58) Field of Classification Search
USPC ..... 439/82, 856–858, 850–855, 83, 567, 439/80–81, 581
See application file for complete search history.

(56) References Cited

U.S. PATENT DOCUMENTS

| | | | | | |
|---|---|---|---|---|---|
| 3,470,529 | A * | 9/1969 | Klumpp, Jr. | 439/869 |
| 5,215,473 | A * | 6/1993 | Brunker et al. | 439/108 |
| 5,468,154 | A * | 11/1995 | Yip et al. | 439/79 |
| 6,041,498 | A * | 3/2000 | Hillbish et al. | 29/883 |
| 6,062,916 | A | 5/2000 | Gladd et al. | |
| 6,139,373 | A * | 10/2000 | Ward et al. | 439/733.1 |
| 6,142,788 | A * | 11/2000 | Han | 439/63 |
| 6,572,404 | B1 * | 6/2003 | Wu | 439/567 |
| 6,648,682 | B1 * | 11/2003 | Wu | 439/567 |
| 6,923,678 | B2 * | 8/2005 | Kato et al. | 439/567 |
| 7,175,447 | B2 * | 2/2007 | Pan | 439/79 |
| 7,344,389 | B2 | 3/2008 | Kramski | |
| 7,789,716 | B2 * | 9/2010 | Fedder et al. | 439/751 |
| 2006/0246786 | A1 * | 11/2006 | Noguchi | 439/751 |

FOREIGN PATENT DOCUMENTS

| | | | | |
|---|---|---|---|---|
| DE | 3801352 | * | 7/1989 | H05K 1/02 |
| DE | 10223382 | | 12/2003 | |
| DE | 10 2006011657 | | 9/2007 | |
| WO | WO 01/11731 | | 2/2001 | |

OTHER PUBLICATIONS

International Search Report, PCT International Patent Application No. PCT/EP2008/067831, dated Mar. 25, 2009.

* cited by examiner

*Primary Examiner* — Jean F Duverne
(74) *Attorney, Agent, or Firm* — Kenyon & Kenyon LLP

(57) ABSTRACT

A press-in contact having a base, a contact pin and a second pin which extends parallel to the contact pin. The second pin projects beyond the contact pin and has a greatest circumference at the same level as a tip of the contact pin. Simple and accurate positioning between a circuit board and a contact pin disposed in a housing is made possible by the second pin which acts as a pre-centering pin.

10 Claims, 20 Drawing Sheets

PRESS-IN CONTACT HAVING A BASE, A CONTACT PIN AND A SECOND PIN

FIELD OF THE INVENTION

The present invention relates to a press-in contact having a base, a contact pin and a second pin which extends parallel to the contact pin, a housing having a contact pin and a second pin or two further pins which extend parallel to the contact pin, a method for inserting a circuit board into a housing having a contact pin and a second pin which extends parallel to the contact pin, and a circuit board having at least two openings of which at least a first opening has a contact sleeve for receiving a press-in pin.

BACKGROUND INFORMATION

German Patent Application No. DE 102 23 382 A1 describes a press-in contact with a press-in base and with at least two contact pins which are referred to therein as press-in pins. Provided in the press-in base there is a slot-shaped recess disposed between the two press-in pins and extending from the underside of the press-in base. That ensures a resilient behavior when the press-in contact having at least two press-in pins is pressed into press-in bores of a circuit board.

German Patent Application No. DE 10 2006 011 657 A1 describes a contact pin for pressing into a through-plated hole, which contact pin has in a press-in portion two contact legs spaced from each other by an elongate opening.

The contact pins have a sharp-edged pin tip formed by a punching and stamping process. In automotive engineering, plastics housings are used into which those press-in contacts may be injection-molded as inserts. A circuit board is insertable into the plastics housing and has openings with copper sleeves in order to make electrically conductive contact with the press-in pins of the press-in contacts. As the circuit board is being inserted into the housing, the press-in pins disposed in the interior of the housing penetrate the copper sleeves. If the circuit board and the housing are not accurately positioned relative to each other during the pressing-in procedure, damage to the copper sleeve occurs. Metal particles that have been chipped off cause electrical short-circuits on the circuit board.

SUMMARY

An object of the present invention is to provide a simple press-in contact. In particular, an aid is to be provided that renders possible simple and accurate positioning between circuit board and a contact pin disposed in a housing.

In accordance with an example embodiment of the present invention, the second pin projects beyond the contact pin and has a greatest circumference at the same level as a tip of the contact pin, and the two further pins project beyond the contact pin and have a greatest circumference at the same level as a tip of the contact pin. The following method steps are employed: the circuit board is inserted into the housing in such a manner as to be laterally displaceable by the second pin and in such a manner that a tip of the contact pin enters an opening without touching and a press-in portion of the contact pin is pressed into the circuit board. The second pin acts as a pre-centering pin and is slightly longer in length than the contact pin and has its widest point in the region of the pin tip of the contact pin. The pre-centering pin is also referred to as a centering pin. The width of the pre-centering pin at the widest point is chosen is such a way that the tolerances of the circuit board are absorbed by the tapered shape of the pre-centering tip and, as the circuit board is being set down, it is laterally corrected by the pre-centering tip. The press-in contact having the contact pin and the pre-centering pin is produced in a single process step. The production process is a punching/stamping process. Since the contact pin and the pre-centering pin are formed in one piece with the base, tolerances are slight. The press-in contact is reproducible with low tolerances.

In an advantageous manner, the centering pin has, at the level of and over a length of the press-in portion of the contact pin, a smaller circumference than the press-in portion. In that manner a mechanical over-determination of the circuit board in the pressed-in state is reliably avoided.

In a simple manner, the second pin is arrow-shaped with a cuboidal shaft and a tip. After the widest point of the pre-centering pin, the pre-centering pin tapers toward the base and forms the shaft. The shaft is elongate and of small circumference. As a result, after the pressing-in procedure, the circuit board is not over-determined laterally. The widest point of the pre-centering pin has a slight amount of clearance inside the pre-centering bore, and therefore the circuit board is not over-determined laterally at the beginning of the pressing-in procedure. The press-in contact is also referred to as an insert, which may be inserted into a mold and thereafter encased in plastics material, that is, cast into a plastics housing. The position of the circuit board within the housing is determined merely by the press-in pin. By virtue of the fact that the press-in contact and the housing are manufactured separately, a simple undercutting of the centering pin is made possible.

In an advantageous manner, the contact pin may have a resilient press-in portion. Simple pressing into an opening of a circuit board is made possible by the resilient press-in portion.

In an advantageous manner, the two further pins may be disposed on a base. Tolerances are therefore slight.

In an advantageous manner, the two further pins may be disposed at two different ends of a narrow side of the housing or diametrically on two opposite narrow sides of the housing. The pins are either arranged in isolation or joined to a contact pin in the housing. If the circuit board and the housing are not positioned accurately relative to each other, relatively large deviations are absorbed and corrected by the widely spaced pre-centering pins at an early stage, that is to say, at an upper end of the tip, and lateral displacement forces are low.

In a simple manner, a diameter of the second opening is 1.2 times to two times the diameter, especially 1.3 times the diameter, of the first opening. That makes simple centering of the circuit board possible.

Disposed on the circuit board in a definable position relative to one another are a contact pin opening having a metallic electrically conductive sleeve and a pre-centering pin opening or two pre-centering pin bores. Those openings are drilled. Tolerances of bores lying close to one another are low.

The bore for the pre-centering pin does not have a metallic sleeve. Accordingly, no metal chips are produced as the pre-centering pin is introduced. Thus, the formation of electrically conductive chips and damage to the copper sleeves of the circuit board as it is threaded onto the press-in pins are avoided. It is merely possible for organic chips and material abraded from the circuit board base material to be produced, such as epoxy resin or glass fibers. Those are electrically noncritical.

A circuit board is positioned with an offset relative to a housing, wherein the maximum offset must be less than half the width of the pre-centering tip. As the circuit board is set down without force, first the pre-centering tips enter the non-metallized bores of the circuit board and correct the position of the circuit board to the extent that, at the level of the tips of the press-in pins, the position of the circuit board is in alignment.

BRIEF DESCRIPTION OF THE DRAWINGS

For a better understanding of the present invention, an exemplary embodiment is described in detail below with reference to the figures.

In the various Figures, similar or identical elements are identified by the same reference numerals.

DETAILED DESCRIPTION OF EXAMPLE EMBODIMENTS

Figure 1A:
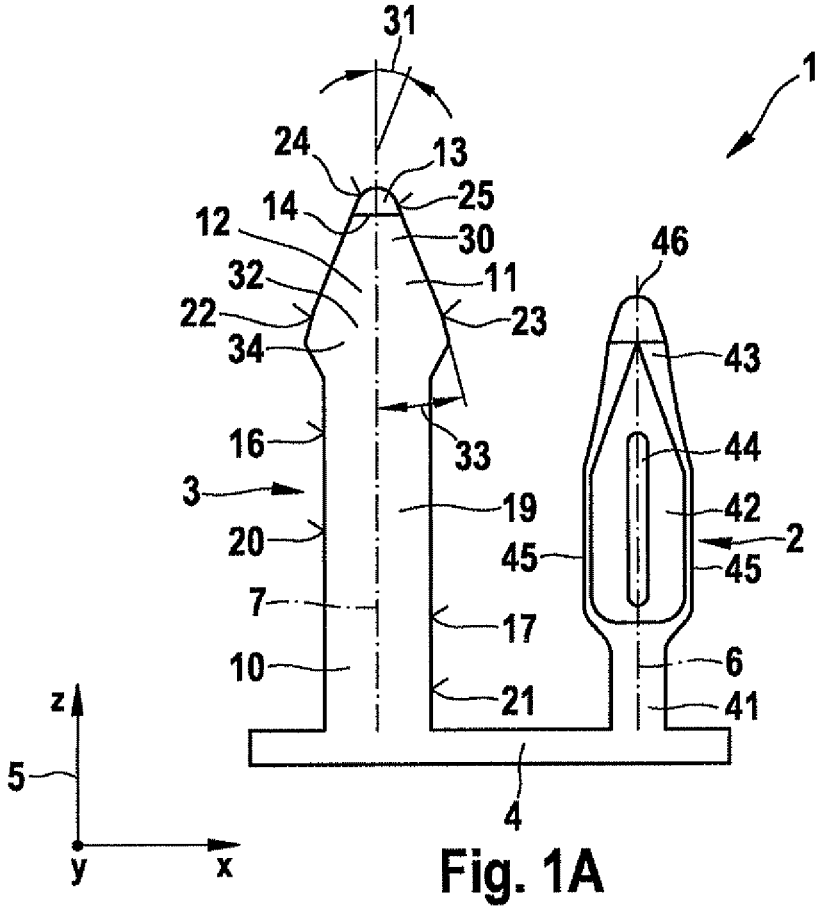
FIG. 1A is a side view of a press-in contact having a contact pin and a centering pin disposed on a base and in a coordinate system comprising an x-, a y- and a z-direction.
Figure 1B:
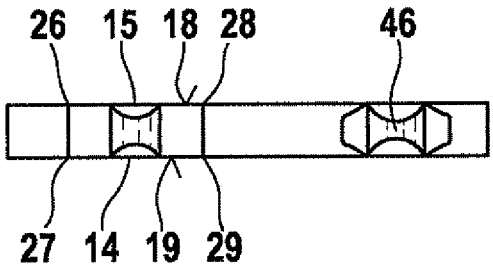
FIG. 1B is a plan view of the press-in contact having the contact pin and the centering pin disposed on the base and of the coordinate system.

FIGS. 1A and 1B show a press-in contact 1 having a contact pin 2 and a second pin 3 on a base 4 in a coordinate system 5 having an x-, a y- and a z-axis. The second pin 3 acts as a centering pin 3 and is also referred to as a pre-centering pin 3 or, in short, as centering pin 3. The press-in contact 1 is punched out of sheet metal and then stamped. The sheet metal is of a constant thickness. A depth of press-in contact 1 is given by the thickness of the sheet metal, is constant and extends in the y-direction. A length and a width of contact pin 2, centering pin 3 and base 4 are obtained as a result of the punching operation and are variable. Contact pin 2 and centering pin 3 are arranged parallel to each other and extend in the z-direction. Contact pin 2 is formed symmetrically with respect to a longitudinal axis 6 extending in the z-direction. Centering pin 3 is formed symmetrically with respect to a second longitudinal axis 7 extending in the z-direction. The width of contact pin 2 and centering pin 3 is defined by an extent in the x-direction.

Centering pin 3 is arrow-shaped with a cuboidal shaft 10 and a tip 11. Shaft 10 and tip 11 are also referred to as arrow shaft 10 and arrowhead 11. Tip 11 has a lower portion 12 and a stamped upper portion 13. Stamped upper portion 13 of tip 11 has delimiting stamped edges 14, 15 which demarcate lower portion 12 and upper portion 13 from each other and define a transition. Centering pin 13 has two narrow surfaces 16, 17 facing away from each other and two arrow-shaped face surfaces 18, 19 facing away from each other. A width of each narrow surface 16, 17 is defined by the depth of press-in contact 1. Each of narrow surfaces 16, 17 is subdivided into a shaft narrow surface 20, 21, a lower portion narrow surface 22, 23 and an upper portion narrow surface 24, 25. Narrow surfaces 16, 17 and face surfaces 18, 19 are delimited by edges 26-29. Arrowhead 11 is widened in the direction toward shaft 10. The widening is defined by way of centering pin axis 7. The widening is symmetrical with respect to centering pin axis 7. The widening is slight and, in an upper arrowhead portion 30, assumes an angle 31 of from 20° to 25°, especially 22°, with respect to centering pin axis 7 and, in a lower arrowhead portion 32, reduces to an angle 33 of from 15° to 22°, especially 18°. That produces an arrowhead portion 34 having a greatest widening, also referred to as an arrowhead portion 34 having a greatest circumference or as the widest point of the pre-centering pin 3. Arrowhead 11 then tapers and becomes arrow shaft 10.

Contact pin 2, also referred to as press-in pin 2, has a cuboidal shaft 41, a cuboidal contact portion 42 and a tip 43. Contact portion 42 has a slot-shaped opening 44 extending in the longitudinal direction and is also referred to as press-in portion 42. Edges 45 extending in the longitudinal direction of cuboidal contact portion 42 are rounded. Contact pin 2 has at tip 43 an upper end 46. Cuboidal contact portion 42 of contact pin 2 has a greater circumference than centering pin shaft 10. Cuboidal contact portion 42 extends at the level of centering pin shaft 10 below arrowhead portion 34 having a greatest widening and is thus disposed below the greatest circumference of centering pin 3. Contact pin tip 43 is disposed at the level of arrowhead portion 34 having a greatest circumference.

Figure 1C:
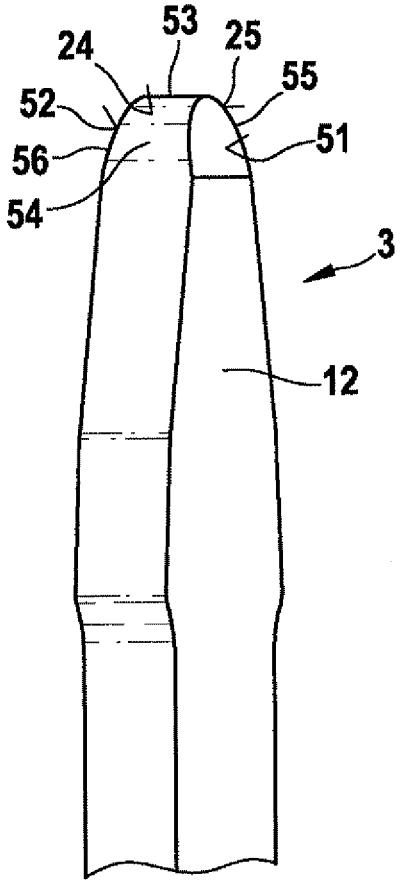
FIG. 1C shows a tip of the contact pin in perspective.

FIG. 1C shows upper portion 12 of centering pin 3. Upper portion 12 is pyramid-shaped with upper portion narrow surfaces 24, 25 and two upper portion face surfaces 51, 52. Upper portion narrow surfaces 24, 25 merge with each other by a curve 54 at an arrowhead end 53. Curve 54 has a narrowest point at arrowhead end 53 and is delimited by two arcuate edges 55 and 56. Upper portion face surfaces 51, 52 of pyramid-shaped upper portion 12 are delimited by the two arcuate edges 55, 56 and are inclined toward each other in an arrow shape.

Figure 2A:
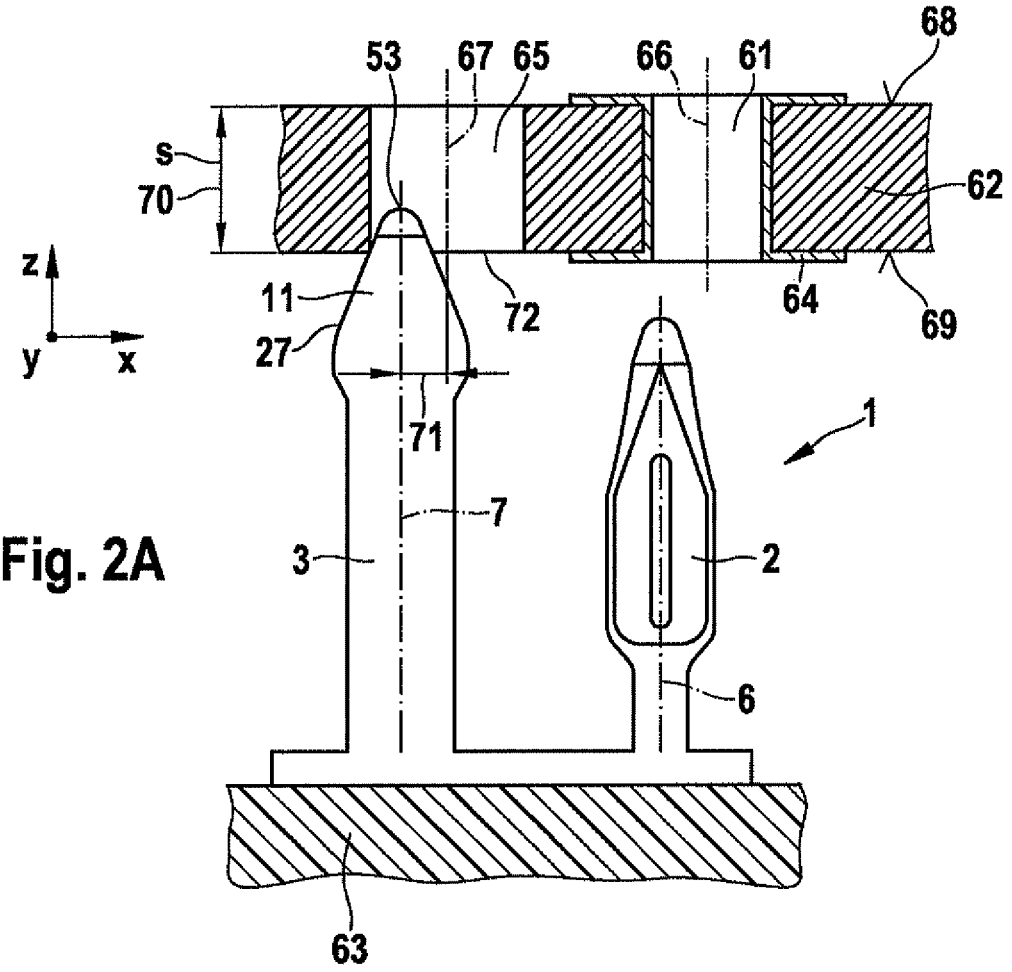
FIG. 2A is a side view of a circuit board having a first and a second opening and of the press-in contact having the contact pin and the centering pin during threading of the contact pin into the first opening, at the beginning of the threading procedure, with a lateral offset in the x-direction.
Figure 2B:
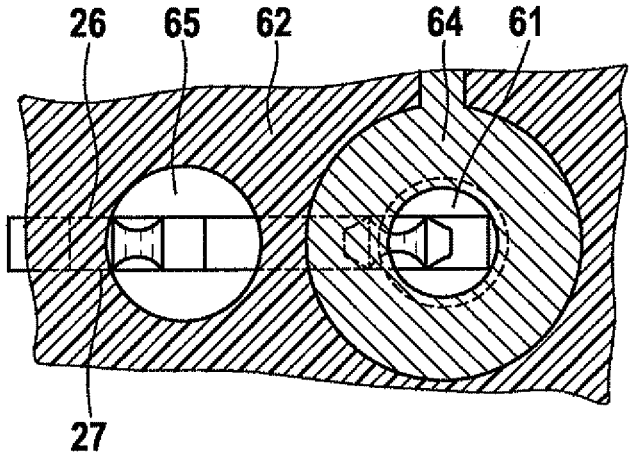
FIG. 2B is a plan view of the circuit board having the first and the second opening and of the press-in contact having the contact pin and the centering pin during threading of the contact pin into the first opening, at the beginning of the threading procedure, with the lateral offset in the x-direction.

FIGS. 2A, 2B, 3A, 3B, 4A, 4B, 5A and 5B show threading of contact pin 2 into a first continuous cylindrical opening 61 of a circuit board 62 during insertion of circuit board 62 into a housing 63. First continuous cylindrical opening 61 is delimited by an electrically conductive contact sleeve 64 disposed on circuit board 62. Circuit board 62 has a second continuous cylindrical opening 65 adjacent to first continuous cylindrical opening 61. Press-in contact 1 having contact pin 2 and centering pin 3 is disposed in housing 63. First continuous cylindrical opening 61 serves to receive contact pin 2 and is therefore also referred to as contact pin opening 61, and second continuous cylindrical opening 65 serves to receive centering pin 3 and is therefore also referred to as centering pin opening 65. Openings 61, 65 each have a cylinder axis 66, 67. Openings 61, 65 are continuous and extend between component-mounting surfaces 68 and 69 which face away from each other. Openings 61, 65 are perpendicular to component-mounting surfaces 68, 69 of circuit board 62. A length s of opening 61, 65 is referred to as opening length 70 and corresponds to the thickness of circuit board 62 or the width of the narrow side of the circuit board. Circuit board 62 is positioned with a maximum possible lateral offset 71 of 0.5 mm relative to housing 63 and maximum possible lateral offset 71 is less than half the width of pre-centering pin 3. At a first stage at the beginning of the threading procedure, arrowhead end 53 of centering pin 3 has penetrated an entry aperture of second opening 65 and travelled one third of opening length 70, as shown in FIGS. 2A and 2B. Contact pin 2 is vertically spaced from circuit board 62 and a projection of contact pin longitudinal axis 6 lies outside first cylindrical opening 61. At the maximum possible lateral offset of circuit board 62 relative to housing 63 in the x-direction, two edges 26, 27 of centering pin tip 11 meet an outer perimeter edge 72 of circuit board 62 delimiting second opening 65. The two edges 26, 27 of centering pin tip 11 delimit a narrow surface 16, 17 and are inclined obliquely with respect to centering pin longitudinal axis 7 and cylinder axis 67 of centering pin opening 65. As circuit board 62 is inserted into housing 63, circuit board 62 slides along inclined edges 26, 27 of centering pin tip delimiting a narrow surface 16, 17 and is displaced laterally.

Figure 3A:
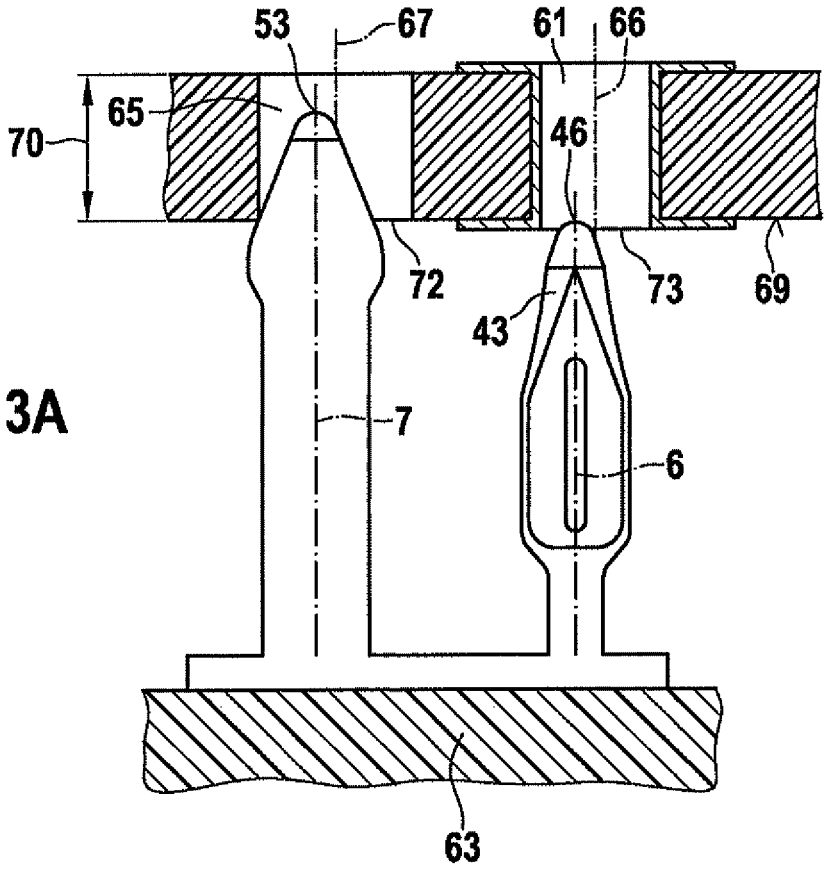
FIG. 3A is a side view of the circuit board having the first and the second opening and of the press-in contact having the contact pin and the centering pin during threading of the contact pin into the first opening, at an advanced stage of the threading procedure, with the lateral offset in the x-direction.
Figure 3B:
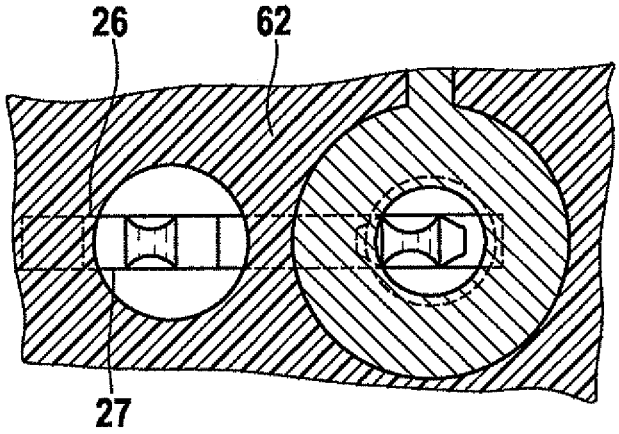
FIG. 3B is a plan view of the circuit board having the first and the second opening and of the press-in contact having the contact pin and the centering pin during threading of the contact pin into the first opening, at the advanced stage of the threading procedure, with the lateral offset in the x-direction.

At a second stage of the threading procedure, the arrowhead end 53 of centering pin 3 has travelled two thirds of opening length 70 inside second opening 65, as shown in FIGS. 3A and 3B. End 46 of contact pin tip 43 has reached a level of lower component-mounting surface 69, and contact pin longitudinal axis 6 has moved closer to cylinder axis 66 of contact pin opening 61 and is spaced from a perimeter edge 73 of contact pin opening 61. Contact pin longitudinal axis 6 is disposed between cylinder axis 66 of contact pin opening 61 and perimeter edge 73 of contact pin opening 61. Cylinder axes 66, 67 of contact pin and centering pin opening 61, 65 are parallel to contact pin and centering pin longitudinal axis 6, 7.

Figure 4A:
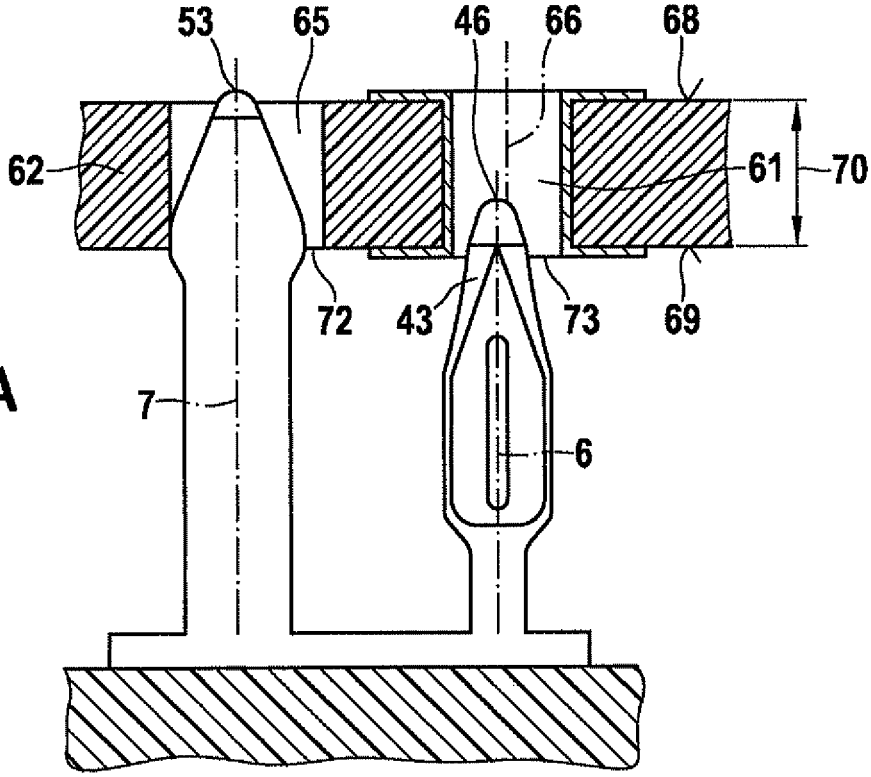
FIG. 4A is a side view of the circuit board having the first and the second opening and of the press-in contact having the contact pin and the centering pin during threading of the contact pin into the first opening, at a further stage of the threading procedure, with the lateral offset in the x-direction.
Figure 4B:
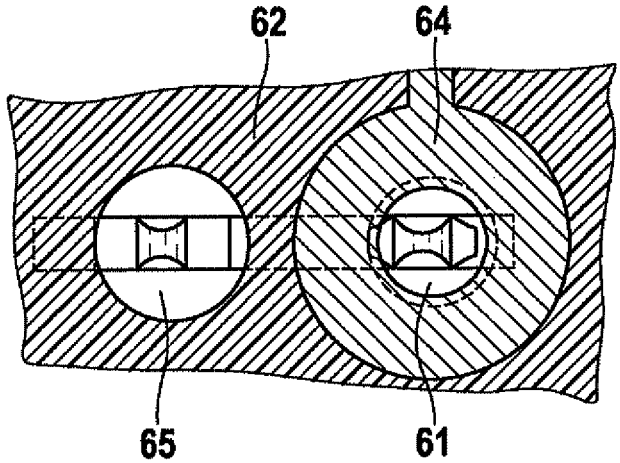
FIG. 4B is a plan view of the circuit board having the first and the second opening and of the press-in contact having the contact pin and the centering pin during threading of the contact pin into the first opening, at the further stage of the threading procedure, with the lateral offset in the x-direction.

At a third stage of the threading procedure, centering pin arrowhead portion 53 having the greatest widening has reached the entry aperture of opening 65 and rests against perimeter edge 72, as shown in FIGS. 4A and 4B. End 46 of contact pin tip 43 has travelled one third of the distance inside opening 61, and contact pin longitudinal axis 6 has moved even closer to cylinder axis 66 of contact pin opening 61 and is spaced further away from perimeter edge 73 of contact pin opening 61. Contact pin tip 43 has entered opening 61 of circuit board 62 without touching. Contact pin longitudinal axis 6 is disposed between cylinder axis 66 of contact pin opening 61 and perimeter edge 73 of contact pin opening 61 and closer to cylinder axis 66 of contact pin opening 61.

Figure 5A:
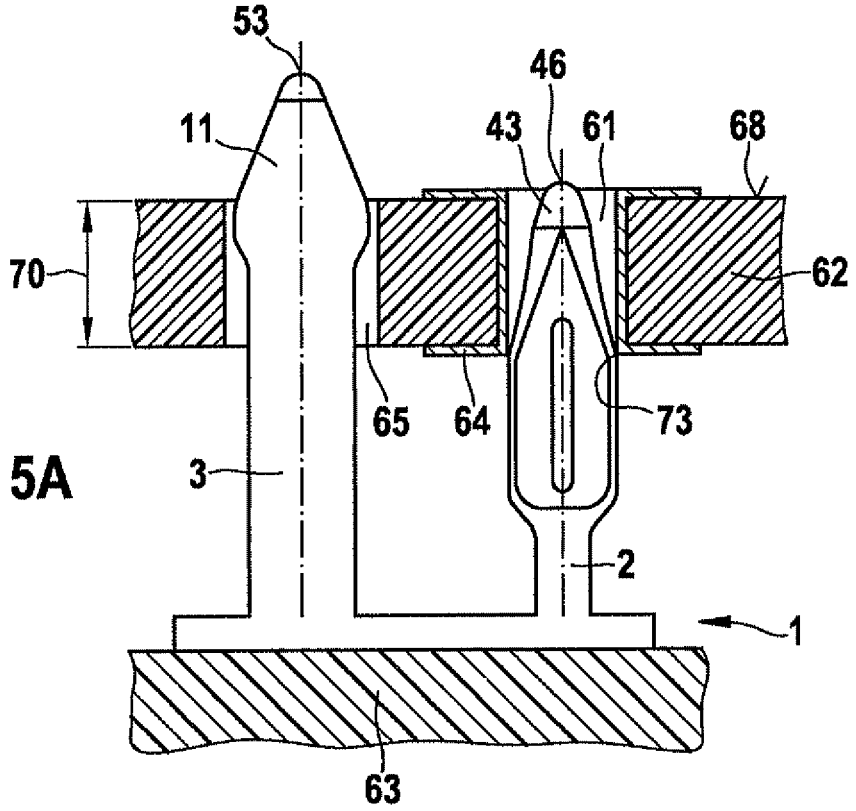
FIG. 5A is a side view of the circuit board having the first and the second opening and of the press-in contact having the contact pin and the centering pin during threading of the contact pin into the first opening, at a fourth stage of the threading procedure, with the lateral offset in the x-direction.
Figure 5B:
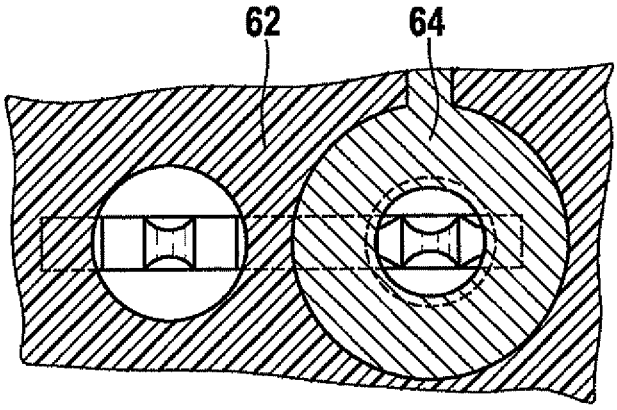
FIG. 5B is a plan view of the circuit board having the first and the second opening and of the press-in contact having the contact pin and the centering pin during threading of the contact pin into the first opening, at the fourth stage of the threading procedure, with the lateral offset in the x-direction.

At a fourth stage of the threading procedure, centering pin arrowhead portion 53 having the greatest widening has travelled two thirds of opening length 70 inside second opening 65, as shown in FIGS. 5A and 5B. Centering pin tip 11 has a slight amount of clearance inside opening 65. Contact pin tip 43 rests with all four edges 45 against a lower perimeter edge 73 of contact pin opening 61. Upper end 46 of contact pin tip 43 has reached a level of upper component-mounting surface 68. A deposited position of circuit board 62 has been reached. The operation of pressing contact pin 2 into copper sleeve 64 begins. On being deposited without force, circuit board 62 is displaced laterally without tilting, with the result that tip 43 of contact pin 2 may be introduced into first opening 61 without touching contact sleeve 64.

Figure 6:
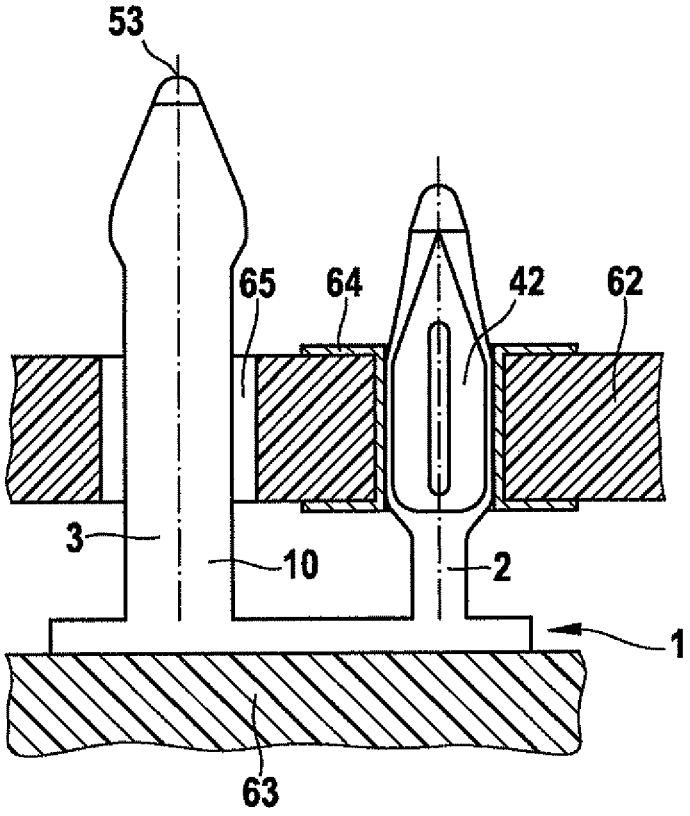
FIG. 6 is a side view of the circuit board having the first and the second opening and of the press-in contact having the contact pin and the centering pin after the operational position of the contact pin has been reached.

At a fifth stage of the threading procedure, a press-in end position of circuit board 62 is reached, as shown in FIG. 6. The press-in end position is also referred to as the operational position. Contact portion 42 of contact pin 2 rests against sleeve 64 over a large surface area. Centering pin 3 has a small circumference at the level of and over the length of press-in portion 42 of contact pin 2. Centering pin shaft 10, which has a small circumference, is disposed at the level of and over the length of press-in portion 42. Centering pin shaft 10 stands free inside centering pin opening 65 of circuit board 62.

Figure 7A:
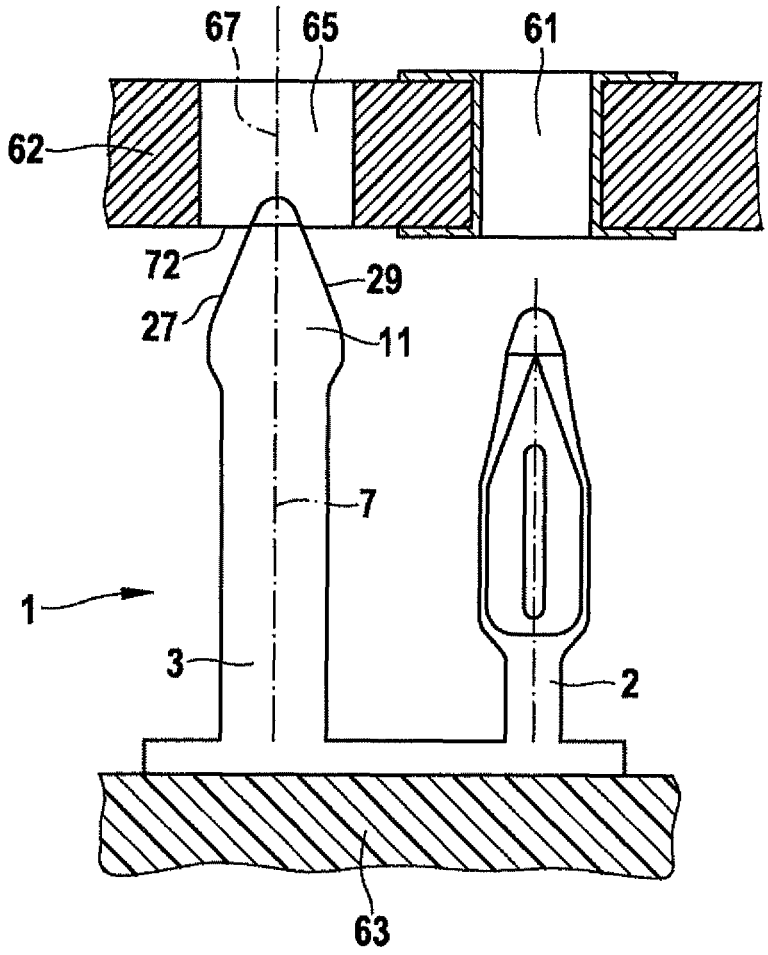
FIG. 7A is a side view of the circuit board having the first and the second opening and of the press-in contact having the contact pin and the centering pin during threading of the contact pin into the first opening, at the beginning of the threading procedure, with a lateral offset in the y-direction.
Figure 7B:
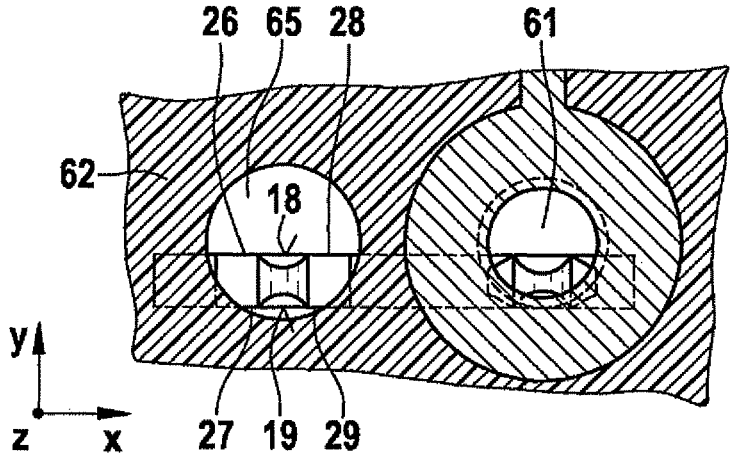
FIG. 7B is a plan view of the circuit board having the first and the second opening and of the press-in contact having the contact pin and the centering pin during threading of the contact pin into the first opening, at the beginning of the threading procedure, with the lateral offset in the y-direction.

FIGS. 7A and 7B show printed circuit board 62 having first and second opening 61, 65 and press-in contact 1 having contact pin 2 and centering pin 3 during threading of contact pin 2 into first opening 61, at the beginning of the threading procedure, with a lateral offset in the y-direction. At the maximum possible lateral offset of circuit board 62 relative to housing 63 in the y-direction, two edges 27, 29 of centering pin tip 11 meet outer perimeter edge 72 of circuit board 62 delimiting second opening 65. The two edges 27, 29 of centering pin tip 11 delimit a face surface 18, 19 and are inclined obliquely with respect to centering pin longitudinal axis 7 and cylinder axis 67 of centering pin opening 65. As circuit board 62 is inserted into housing 63, circuit board 62 slides along inclined edges 27, 28 of centering pin tip 11 delimiting a face surface 18, 19 and is displaced laterally. At a maximum possible lateral offset of circuit board 62 relative to housing 63 in any direction, at least one of edges 26-29 of centering pin tip 11 meets outer perimeter edge 72 of circuit board 62 delimiting second opening 65. As circuit board 62 is inserted into housing 63, circuit board 62 slides along at least one of edges 26-29 of centering pin tip 11 and is displaced laterally.

Figure 8A:
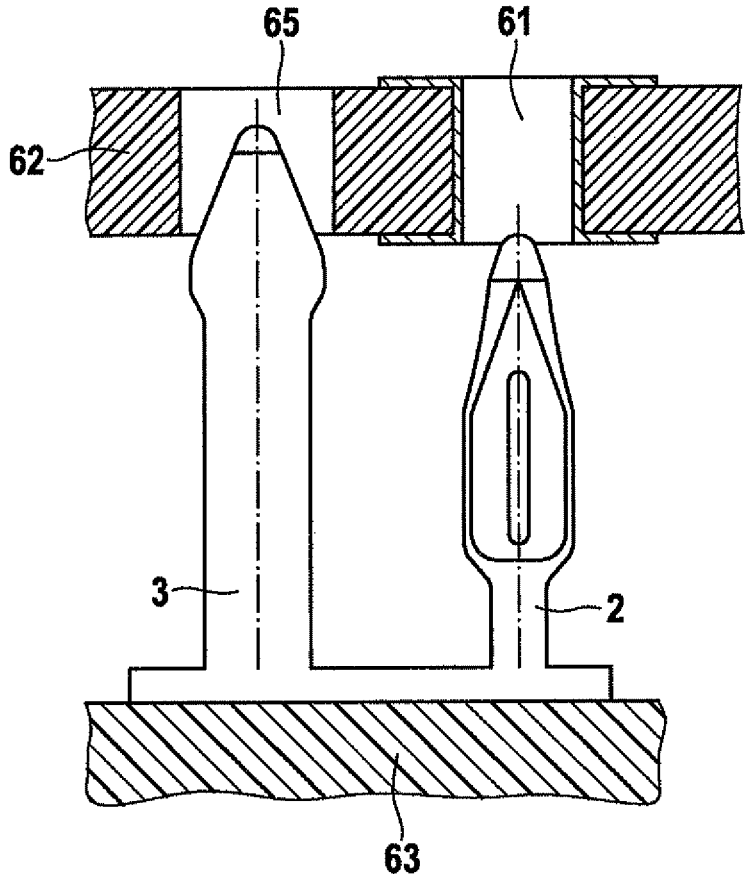
FIG. 8A is a side view of the circuit board having the first and the second opening and of the press-in contact having the contact pin and the centering pin during threading of the contact pin into the first opening, at an advanced stage of the threading procedure, with the lateral offset in the y-direction.
Figure 8B:
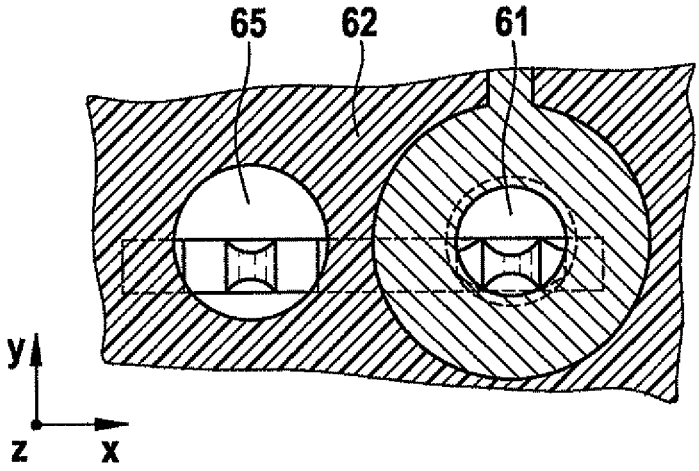
FIG. 8B is a plan view of the circuit board having the first and the second opening and of the press-in contact having the contact pin and the centering pin during threading of the contact pin into the first opening, at the advanced stage of the threading procedure, with the lateral offset in the y-direction.

FIGS. 8A and 8B show circuit board 62 having first and second opening 61, 65 and press-in contact 1 having contact pin 2 and centering pin 3 during threading of contact pin 2 into first opening 61, at an advanced stage of the threading procedure, with the lateral offset in the y-direction.

Figure 9A:
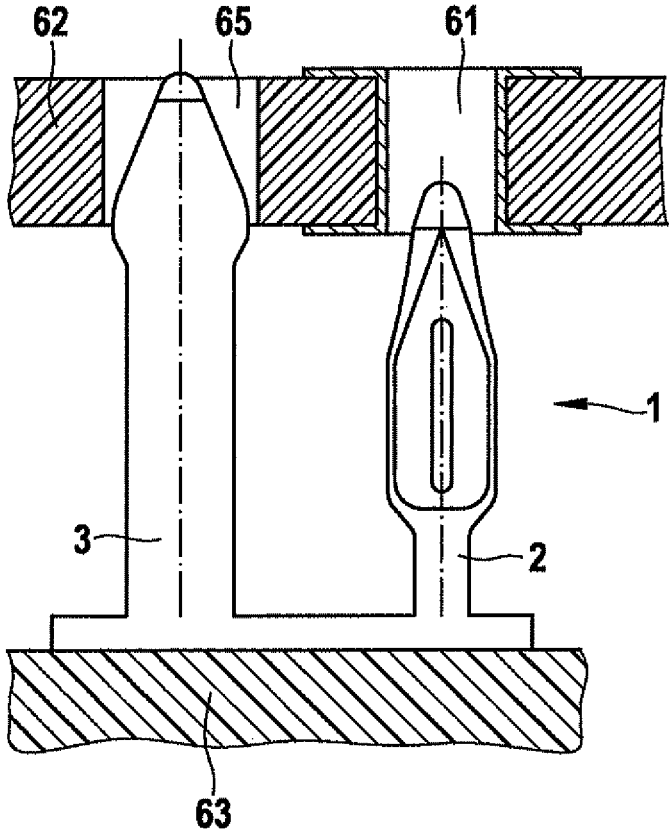
FIG. 9A is a side view of the circuit board having the first and the second opening and of the press-in contact having the contact pin and the centering pin during threading of the contact pin into the first opening, at a further stage of the threading procedure, with the lateral offset in the y-direction.
Figure 9B:
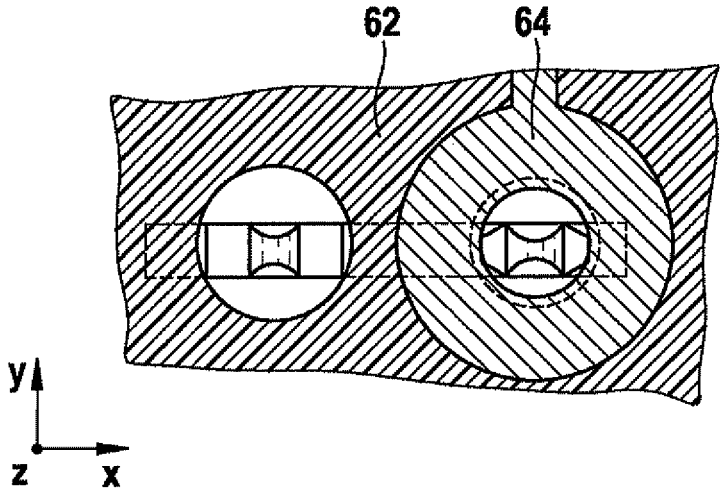
FIG. 9B is a plan view of the circuit board having the first and the second opening and of the press-in contact having the contact pin and the centering pin during threading of the contact pin into the first opening, at the further stage of the threading procedure, with the lateral offset in the y-direction.

FIGS. 9A and 9B show circuit board 62 having first and second opening 61, 65 and press-in contact 1 having contact pin 2 and centering pin 3 during threading of contact pin 2 into first opening 61, at a further stage of the threading procedure, with the lateral offset in the y-direction.

Figure 10A:
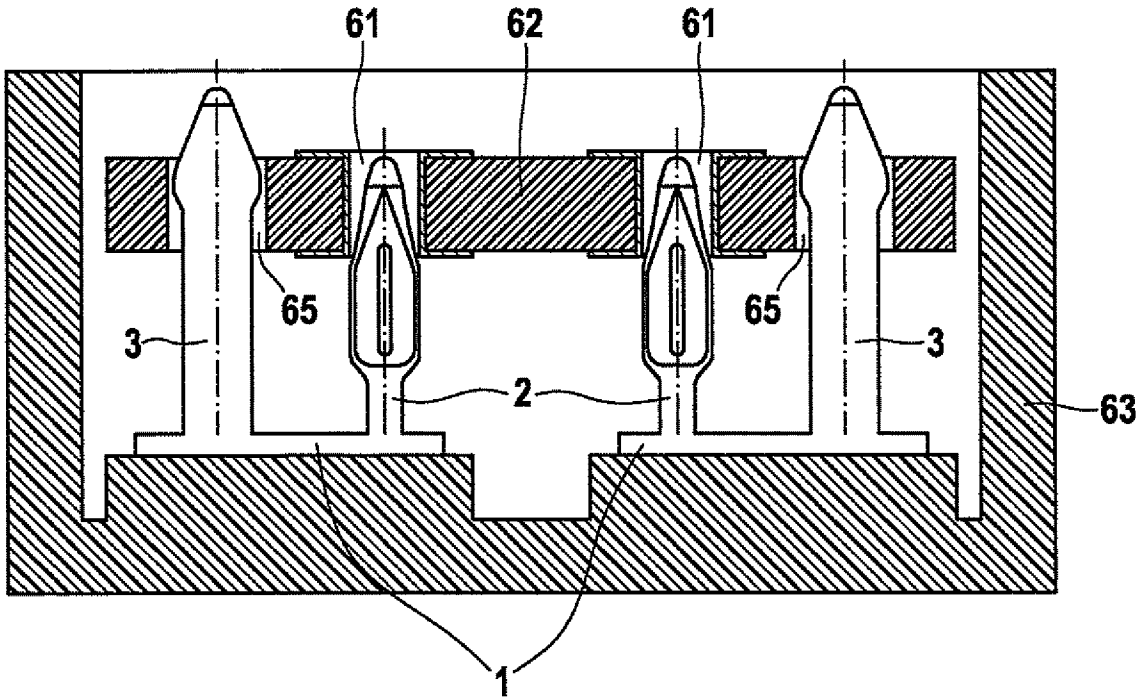
FIG. 10A shows from the side and in section a housing with two press-in contacts each having a centering pin and a contact pin, disposed on one narrow side of the housing, and a circuit board having openings, before the contact pins are pressed into two of the openings.
Figure 10B:
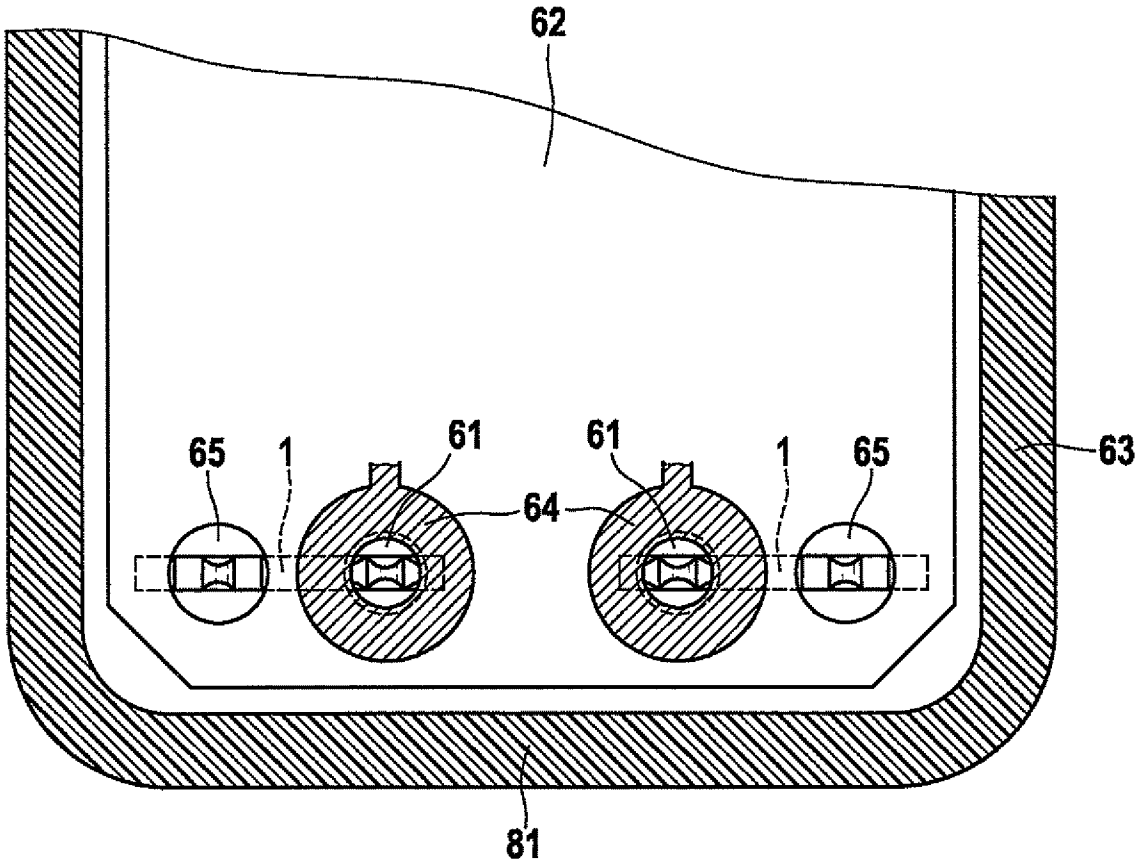
FIG. 10B is a plan view of the housing with the two press-in contacts each having the centering pin and the contact pin, disposed on the narrow side of the housing, and of the circuit board having the openings, before the contact pins are pressed into two of the openings.

FIGS. 10A and 10B show a housing 63 with two press-in contacts 1 each having a centering pin 3 and a contact pin 2, disposed on one narrow side 81 of housing 63, and circuit board 62 having openings 61, 65 during threading of pins 2, 3 into openings 61, 65.

Figure 11A:
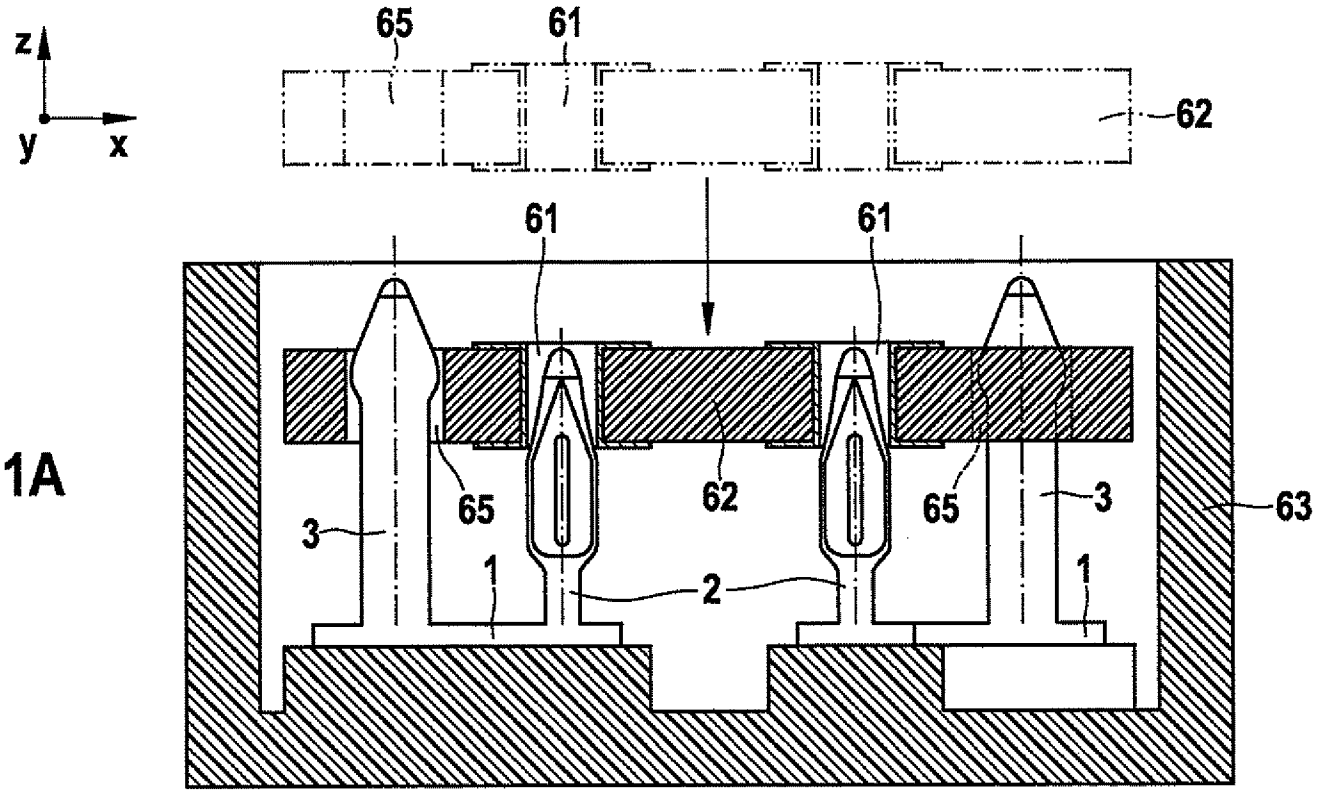
FIG. 11A shows from the side and in section a further housing with two press-in contacts each having a centering pin and a contact pin, disposed on two opposite narrow sides of the housing, and a circuit board having openings, before the contact pins are pressed into two of the openings.
Figure 11B:
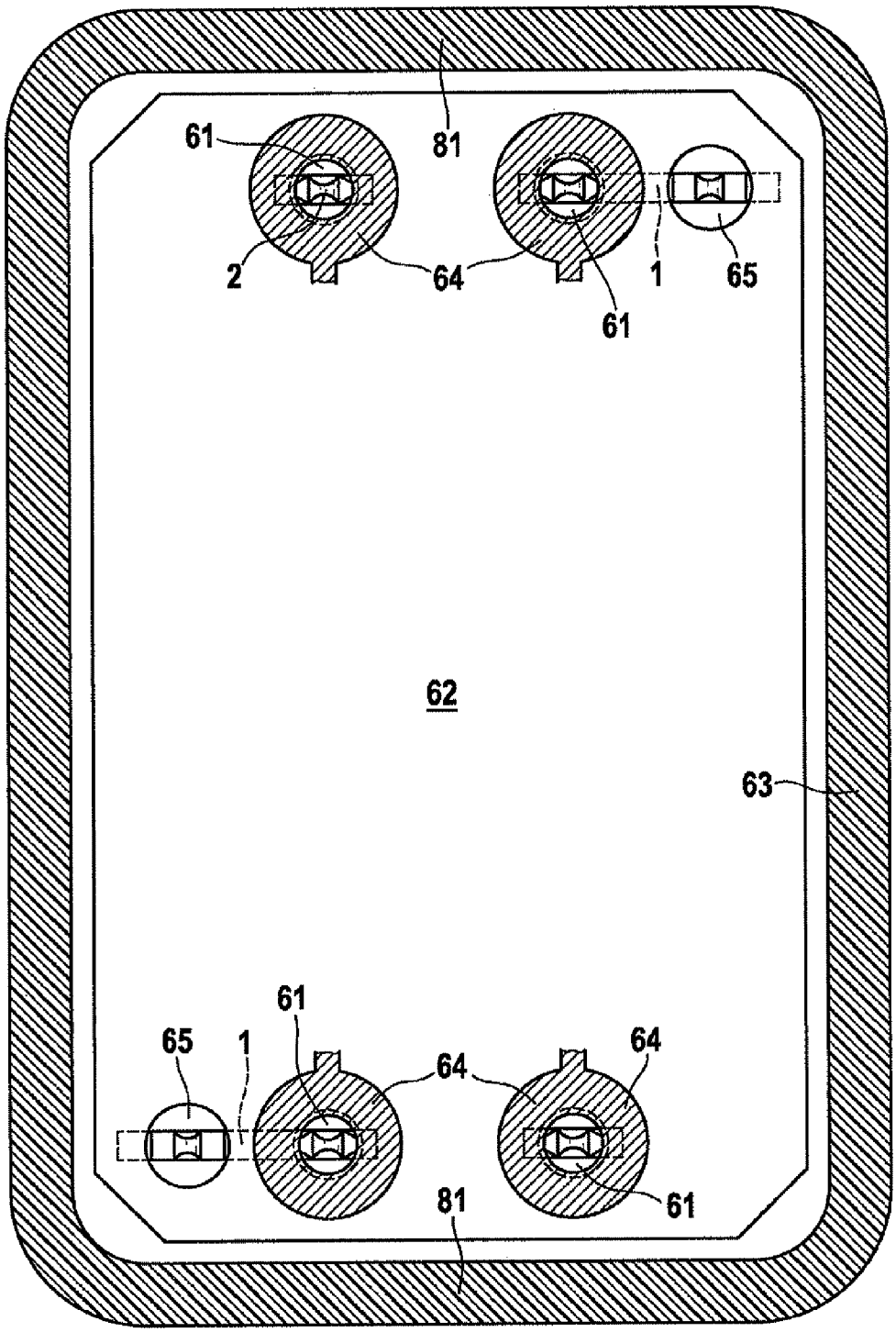
FIG. 11B is a plan view of the further housing with the two press-in contacts each having a centering pin and a contact pin, disposed on two opposite narrow sides of the housing, and of the circuit board having openings, before the contact pins are pressed into two of the openings.

FIGS. 11A and 112 show a further housing 63 with two press-in contacts 1 each having a centering pin 3 and a contact pin 2, disposed on two opposite narrow sides 81 of housing 63, and circuit board 62 having openings 61, 65 during threading of pins 2, 3 into openings 61, 65. Press-in contacts 1 are disposed diametrically opposite each other and parallel to narrow sides 81 of housing 63. In addition to press-in contacts 1, stand-alone contact pins are used. Contact pins 2 are disposed in openings 61 having contact sleeves 64.

Figure 12A:
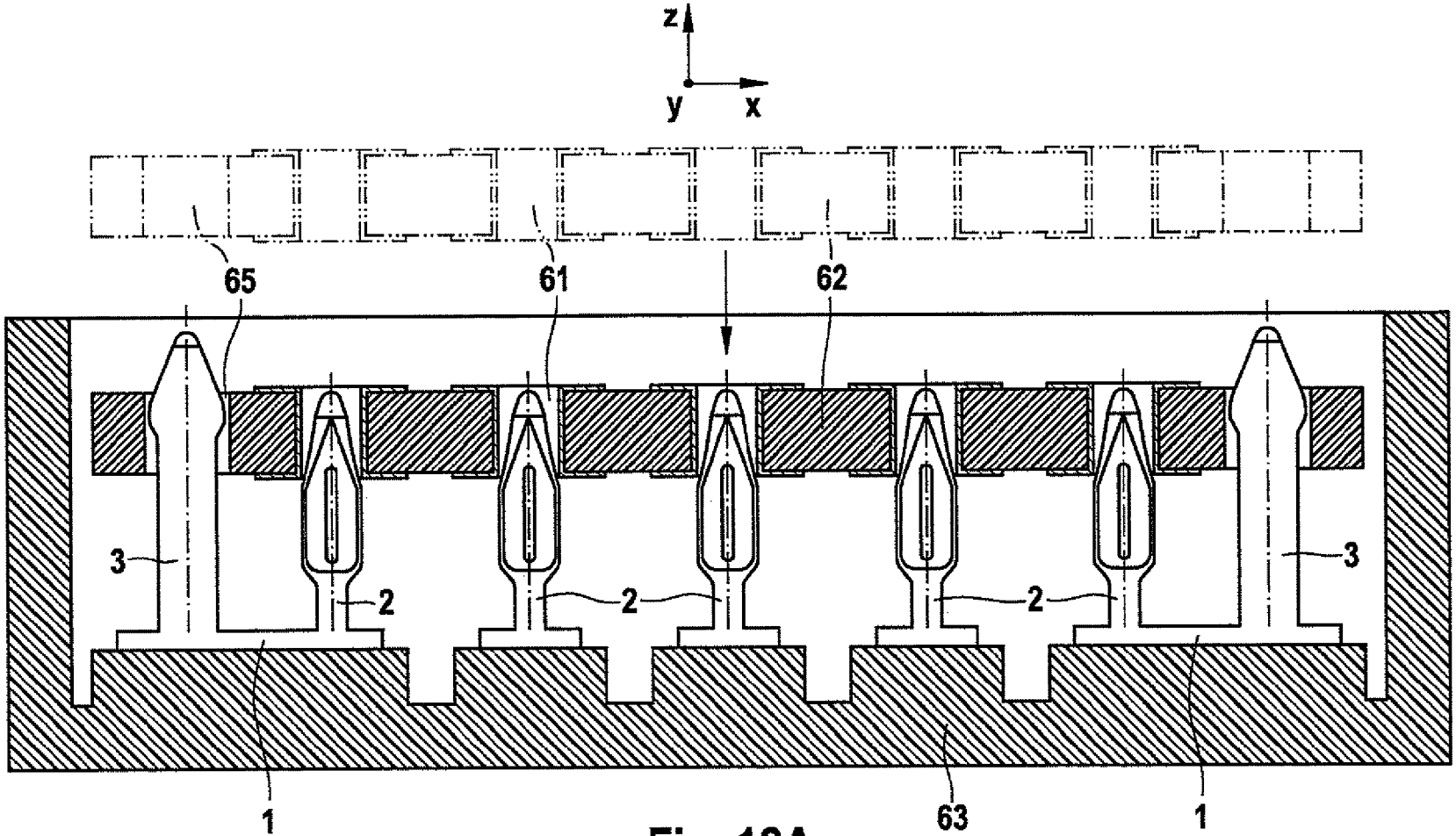
FIG. 12A shows from the side and in section a third housing with two press-in contacts each having a centering pin and a contact pin, disposed on one narrow side of the housing, and three contact pins and a circuit board having seven openings, before the contact pins are pressed into five of the openings.
Figure 12B:
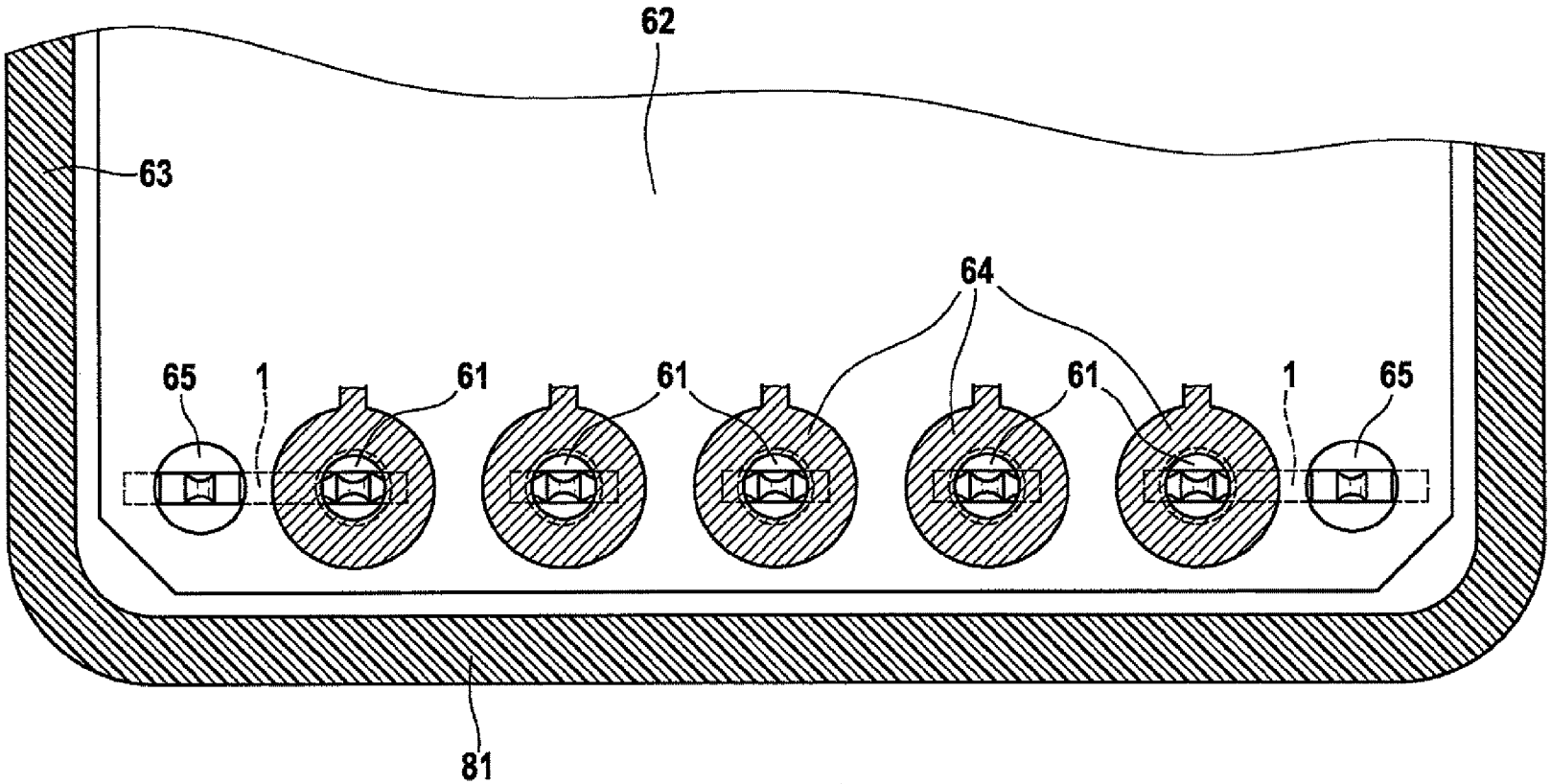
FIG. 12B is a plan view of the third housing with the two press-in contacts each having a centering pin and a contact pin, disposed on the narrow side of the housing, and of the three contact pins and the circuit board having the seven openings, before the contact pins are pressed into five of the openings.

FIGS. 12A and 12B show a third housing 63 with two press-in contacts 1 each having a centering pin 3 and a contact pin 2, disposed on one narrow side 81 of the housing, and three contact pins 2 and circuit board 62 having seven openings 61, 65 during threading of pins 2, 3 into openings 61 and 65.

Figure 13A:
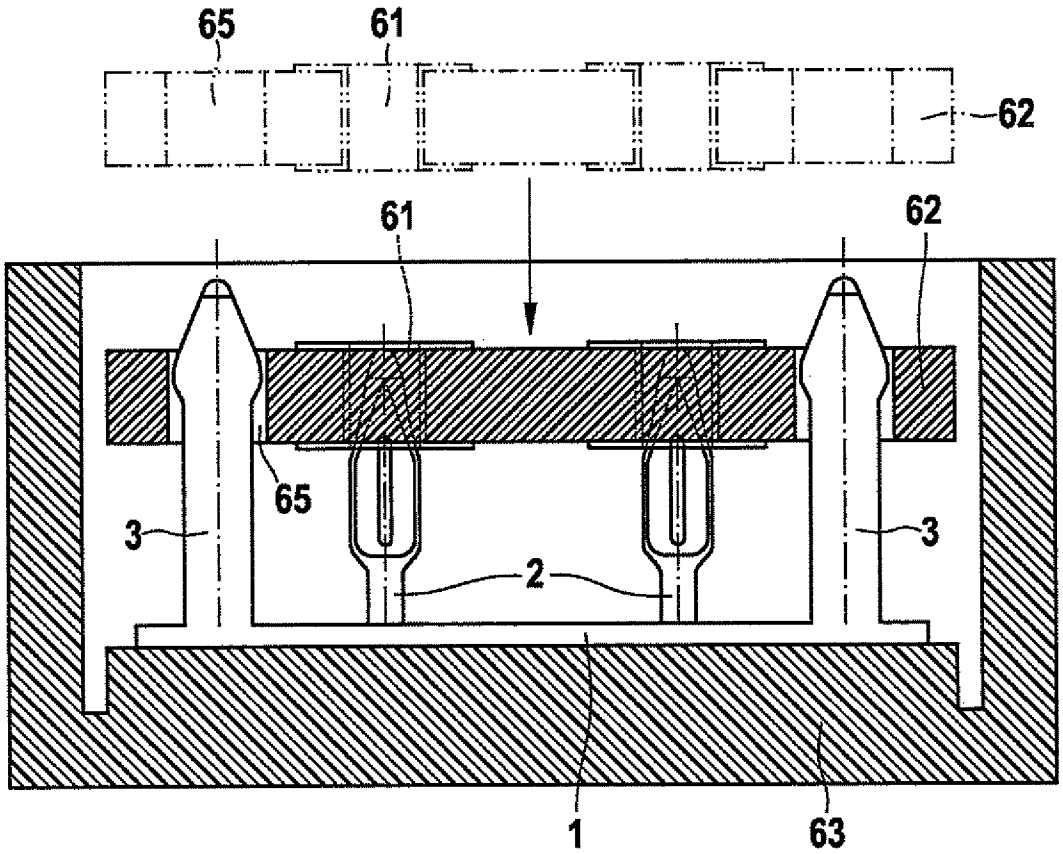
FIG. 13A shows from the side and in section two centering pins connected by a base and, offset therefrom, two contact pins on one narrow side of a fourth housing, and a circuit board having four openings, before the contact pins are pressed into two of the openings.
Figure 13B:
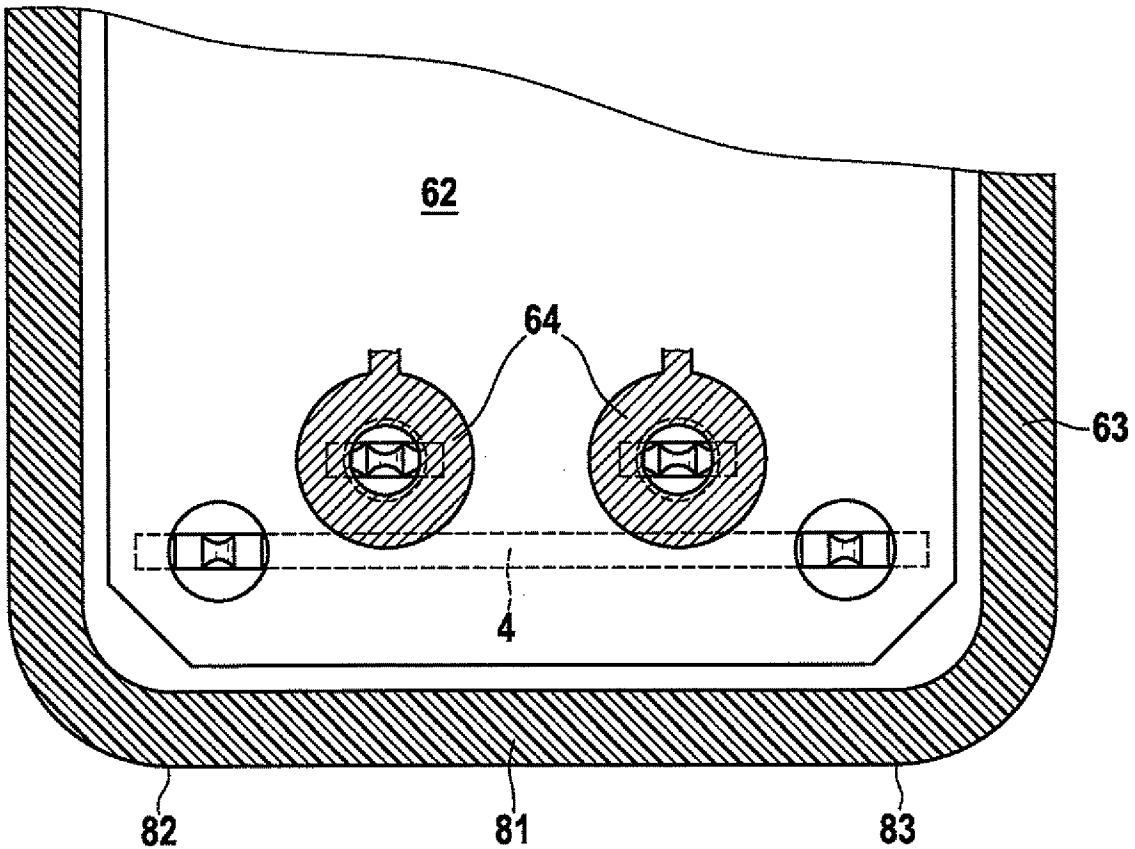
FIG. 13B is a view of the two centering pins connected by a base and, offset therefrom, the two contact pins on one narrow side of the fourth housing, and of the circuit board having the four openings, before the contact pins are pressed into two of the openings.

FIGS. 13A and 13B show a fourth housing 63 with two centering pins 3 disposed on a base 4. Contact pins 2 are disposed in offset relationship to centering pins 3. The two centering pins 3 are disposed at two different ends 82, 83 of one narrow side 81.

Figure 14A:
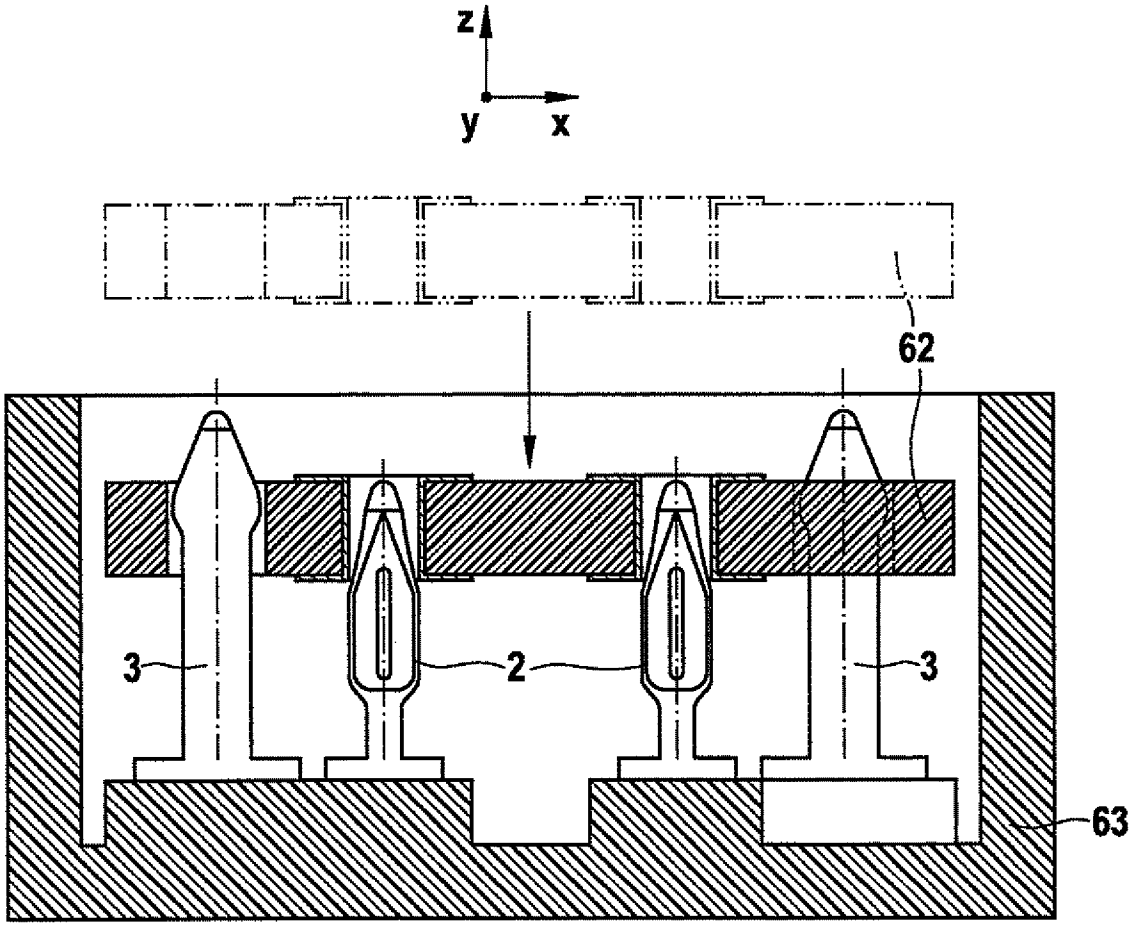
FIG. 14A shows from the side and in section four contact pins and two centering pins disposed singly and diametrically opposite each other in a housing, and a circuit board having six openings, before the contact pins are pressed into four of the openings.
Figure 14B:
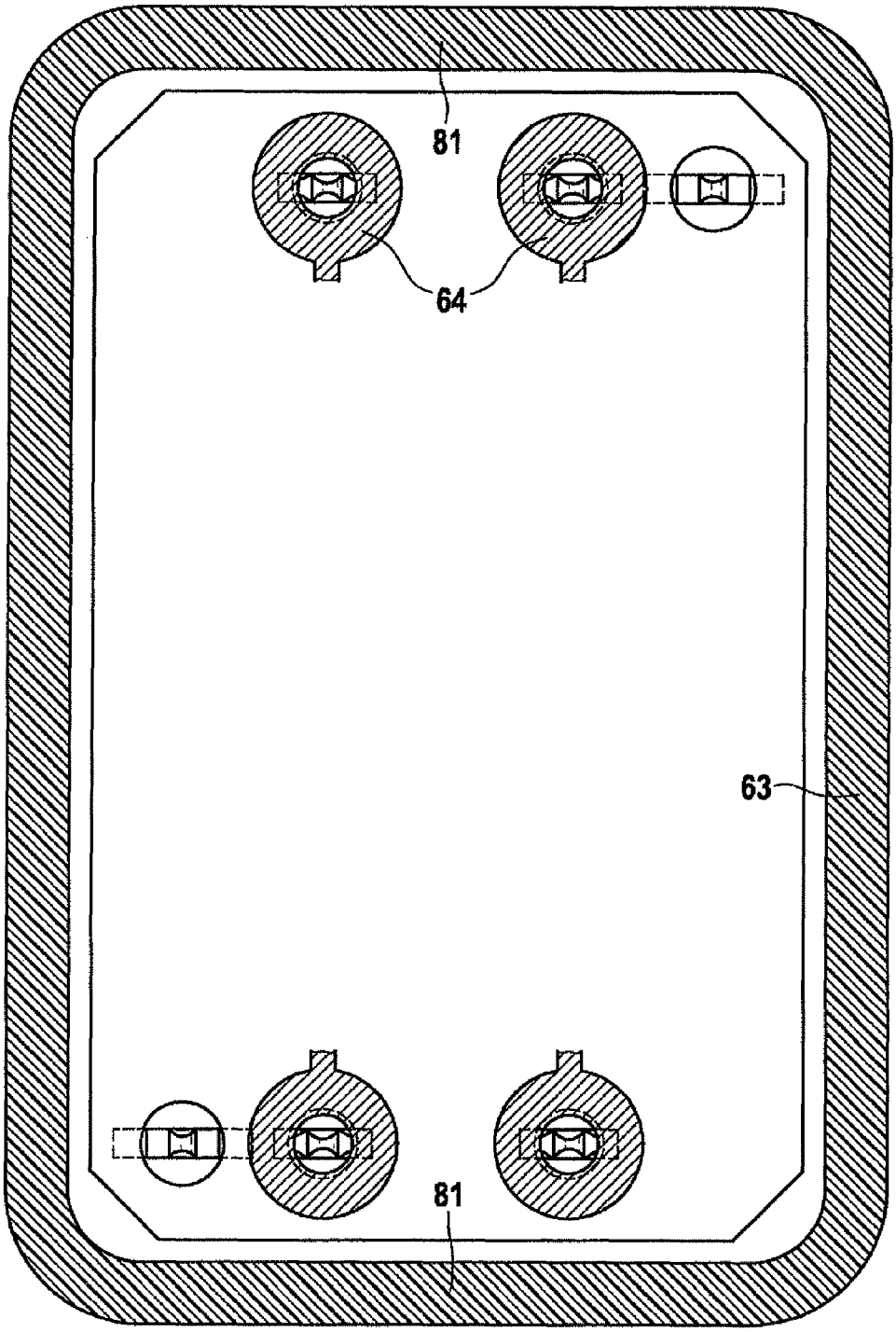
FIG. 14B is a plan view of the four contact pins and the two centering pins disposed singly and diametrically opposite each other in a housing, and of the circuit board having six openings, before the contact pins are pressed into four of the openings.

FIGS. 14A and 14B show a fifth housing 63 with two individual centering pins 3 disposed in housing 63 diametrically on opposite narrow sides 81, and four individually disposed contact pins 2.

What is claimed is:

1. A press-in contact, comprising:

a base;

a contact pin extending from the base and having a press-in portion of a resilient configuration; and a second pin which extends from the base parallel to the contact pin;

wherein the second pin projects beyond the contact pin and has a greatest circumference at a same level as a tip of the contact pin.

2. The press-in contact as recited in claim 1, wherein the second pin has, at a level of and over a length of the press-in portion of the contact pin, a smaller circumference than the press-in portion.

3. The press-in contact as recited in claim 1, wherein the second pin is arrow-shaped with a cuboidal shaft and a tip.

4. A housing having a contact pin having a press-in portion of a resilient configuration, and a second pin which extends parallel to the contact pin, wherein the second pin projects beyond the contact pin and has a greatest circumference at a same level as a tip of the contact pin.

5. A housing having a contact pin having a press-in portion of a resilient configuration, and two further pins which extend parallel to the contact pin, the two further pins projecting beyond the contact pin and having a greatest circumference at a same level as a tip of the contact pin.

6. The housing as recited in claim 5, wherein the two further pins are disposed on a base.

7. The housing as recited in claim 5, wherein the two further pins are disposed at two different ends of a narrow side of the housing.

8. The housing as recited in claim 5, wherein the two further pins are disposed diametrically on two opposite narrow sides of the housing.

9. A circuit board having at least two openings of which at least a first opening has a contact sleeve for receiving a press-in pin of a housing, and a second opening, the press-in pin having a press-in portion of a resilient configuration, the housing having a second pin which extends parallel to the press-in pin, the second pin projecting beyond the press-in pin and having a greatest circumference at a same level as a tip of the press-in pin, the second opening for receiving the second pin, wherein a diameter of the second opening is at least 1.2 times to two times the diameter of the first opening.

10. The circuit board as recited in claim 9, wherein a second opening is 1.3 times the diameter of the first opening.

* * * * *